US008584774B2

(12) United States Patent
Connell

(10) Patent No.: US 8,584,774 B2
(45) Date of Patent: Nov. 19, 2013

(54) TRAVELING AND LOCKING CENTRALIZER

(75) Inventor: Stuart A. Connell, Sherman, TX (US)

(73) Assignee: Caterpillar Global Mining Equipment LLC, South Milwaukee, WI (US)

( * ) Notice: Subject to any disclaimer, the term of this patent is extended or adjusted under 35 U.S.C. 154(b) by 455 days.

(21) Appl. No.: 12/793,987

(22) Filed: Jun. 4, 2010

(65) Prior Publication Data

US 2011/0297446 A1 Dec. 8, 2011

(51) Int. Cl.
*E21B 15/00* (2006.01)

(52) U.S. Cl.
USPC ..... 175/220; 175/52

(58) Field of Classification Search
USPC ..... 173/147, 141, 156, 152; 175/220
See application file for complete search history.

(56) References Cited

U.S. PATENT DOCUMENTS

| | | | | |
|---|---|---|---|---|
| 2,726,065 | A * | 12/1955 | Feucht | 173/147 |
| 2,828,109 | A * | 3/1958 | Dellner | 384/24 |
| 2,976,943 | A * | 3/1961 | Curtis | 173/164 |
| 3,275,388 | A | 9/1966 | Zettergren | |
| 3,493,061 | A | 2/1970 | Gyongyosi | |
| 3,533,920 | A | 10/1970 | Covino | |
| 3,574,071 | A | 4/1971 | Covino | |
| 3,805,463 | A | 4/1974 | Lang et al. | |
| 3,860,126 | A | 1/1975 | Neimark et al. | |
| 3,913,753 | A | 10/1975 | Swartz et al. | |
| 3,920,087 | A | 11/1975 | Hisey et al. | |
| 3,944,300 | A | 3/1976 | Learmont et al. | |
| 3,973,634 | A * | 8/1976 | Persson et al. | 173/147 |
| 3,977,480 | A | 8/1976 | Hilding | |
| 3,980,144 | A | 9/1976 | Roos et al. | |
| 4,321,746 | A | 3/1982 | Grinage | |
| 4,402,557 | A | 9/1983 | Paasonen et al. | |
| 4,892,161 | A | 1/1990 | Ebeling | |
| 4,972,911 | A | 11/1990 | Rajakallio | |
| 5,817,267 | A | 10/1998 | Covino et al. | |
| 5,931,231 | A | 8/1999 | Mock | |
| 5,931,238 | A | 8/1999 | Gilmore et al. | |
| 5,988,298 | A | 11/1999 | Cheng et al. | |

(Continued)

FOREIGN PATENT DOCUMENTS

| | | |
|---|---|---|
| EP | 0 387 017 | 9/1990 |
| EP | 0 519397 | 10/1996 |
| JP | 11-036774 | 2/1999 |
| WO | WO 2008/142201 | 11/2008 |

OTHER PUBLICATIONS

International Search Report and Written Opinion for Application No. PCT/US2011/037426, mail date Dec. 27, 2011, 6 pages.

(Continued)

*Primary Examiner* — Giovanna Wright
*Assistant Examiner* — Ronald Runyan
(74) *Attorney, Agent, or Firm* — Foley & Lardner LLP

(57) ABSTRACT

A drill system for use with a drill rod includes a support member, and a drill assembly movably associated with the support member and configured to be connected to the drill rod. The system further includes a centralizing device movably associated with the support member and configured to receive the drill rod. The centralizing device includes a movable jaw and a latch arm connected to the jaw and configured to move the jaw between an open position and a closed position for retaining the drill rod. Furthermore, the latch arm has a locking feature configured to hold the latch arm in a locked position to thereby hold the jaw in the closed position.

21 Claims, 6 Drawing Sheets

(56) References Cited

U.S. PATENT DOCUMENTS

| | | | |
|---|---|---|---|
| 6,454,026 | B1 | 9/2002 | Shofner |
| 6,871,830 | B2 | 3/2005 | Covino |
| 7,250,194 | B2 | 7/2007 | Aversenti et al. |
| 7,886,846 | B2 | 2/2011 | Pires |
| 2002/0117307 | A1 | 8/2002 | Bystedt |
| 2006/0162963 | A1 | 7/2006 | Hagemeyer et al. |
| 2007/0227752 | A1 | 10/2007 | Voimanen et al. |
| 2010/0071622 | A1 | 3/2010 | Carlson et al. |

OTHER PUBLICATIONS

International Search Report and Written Opinion for International Application No. PCT/US2011/021077, mail date Jul. 29, 2011, 7 pages.

* cited by examiner

TRAVELING AND LOCKING CENTRALIZER

BACKGROUND

1. Field

The disclosure relates to a centralizer for use with a drill system.

2. Background Art

A rock drill system may include a drill assembly slidably mounted on a feed guide or channel, such that the drill assembly is movable along a longitudinal axis of the feed channel. One or more drill rods may be connected to the drill assembly for drilling a hole into a rock formation to a desired depth. The rock drill system may also be provided with a centralizer that assists in keeping the drill rods aligned. An example of such a centralizer is disclosed in U.S. Pat. No. 5,988,298.

SUMMARY

In one embodiment according to the present disclosure, a drill system for use with a drill rod includes a support member, and a drill assembly movably associated with the support member and configured to be connected to the drill rod. The system further includes a centralizing device movably associated with the support member and configured to receive the drill rod. The centralizing device includes a movable jaw and a latch arm connected to the jaw and configured to move the jaw between an open position and a closed position for retaining the drill rod. Furthermore, the latch arm has a locking feature configured to hold the latch arm in a locked position to thereby hold the jaw in the closed position.

In another embodiment, a drill system for use with a drill rod includes a drill guide having first and second ends, a first ramp disposed proximate the first end, and a second ramp disposed between the first ramp and the second end. The system further includes a drill assembly movably associated with the drill guide and configured to be connected to the drill rod, and a centralizing device movably associated with the drill guide such that the centralizing device remains positioned between the drill assembly and the first end of the drill guide during use. The centralizing device is configured to receive an intermediate section of the drill rod to guide the drill rod. Furthermore, the centralizing device includes a device body slidably mounted on the drill guide, a movable jaw that is movable with respect to the device body between an open position and a closed position for retaining the drill rod, a link member connected to the jaw, and a latch arm pivotally attached to the link member and configured to move the jaw between the open and closed positions. The latch arm has a locking feature that is engageable with the device body for holding the latch arm in a locked position to thereby hold the jaw in the closed position. The first ramp is engageable with the latch arm when the centralizing device is moved toward the first end of the drill guide, and the second ramp is engageable with the latch arm when the centralizing device is moved toward the second end of the drill guide. Upon engagement with the latch arm, each ramp is configured to move the latch arm away from the locked position to thereby move the jaw to the open position.

While exemplary embodiments are illustrated and disclosed, such disclosure should not be construed to limit the claims. It is anticipated that various modifications and alternative designs may be made without departing from the scope of the invention.

DETAILED DESCRIPTION

The present disclosure describes a drill system including various apparatuses for aligning one or more drill rods of the drill system. Several specific embodiments are set forth in the following description and in FIGS. 1-10 to provide a thorough understanding of certain embodiments according to the present disclosure.

As those of ordinary skill in the art will understand, various features of the embodiments illustrated and described with reference to any one of the Figures may be combined with features illustrated in one or more other Figures to produce embodiments that are not explicitly illustrated or described. In addition, other embodiments may be practiced without several of the specific features explained in the following description.

Figure 1:
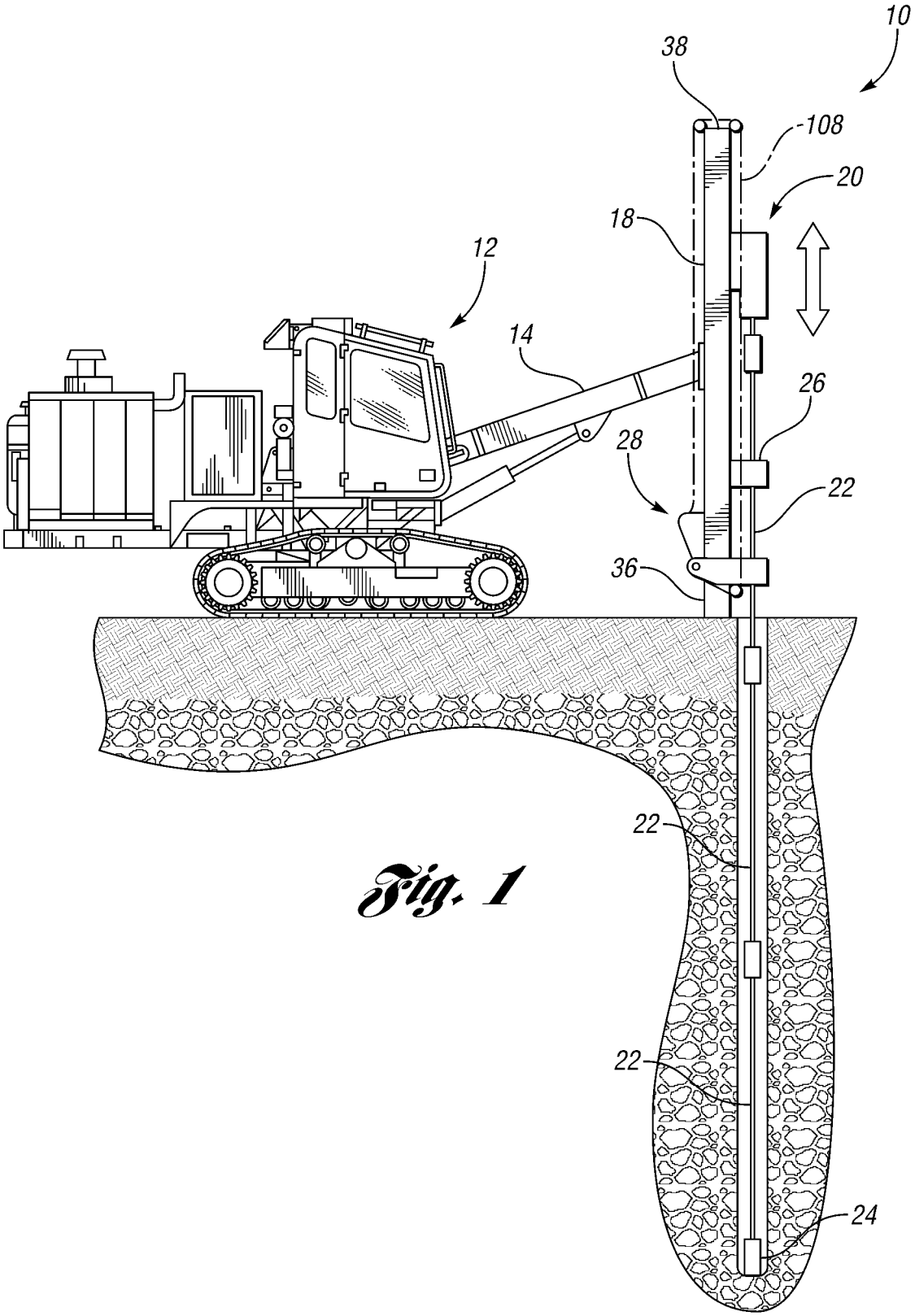
FIG. 1 is a schematic view of a drill system according to the present disclosure mounted on a vehicle.

FIG. 1 shows an embodiment of a drill system 10 in accordance with the present disclosure. The drill system 10 may be a rock drill system, for example, that is used to drill holes into rock formations or any other material. Furthermore, holes may be drilled vertically, horizontally, or at any suitable angle.

The drill system 10 shown in FIG. 1 is a portable system mounted on a vehicle 12, such as tracked utility vehicle, wheeled vehicle, or any other suitable vehicle, via a pivotable or otherwise movable boom 14. The drill system 10 may also be pivotally or otherwise movably mounted to the boom 14 so that the drill system 10 may positioned at any suitable angle with respect to the boom 14. As another example, the drill system 10 may be mounted on a fixed structure, such as a stationary frame, via a movable boom.

Figure 2:
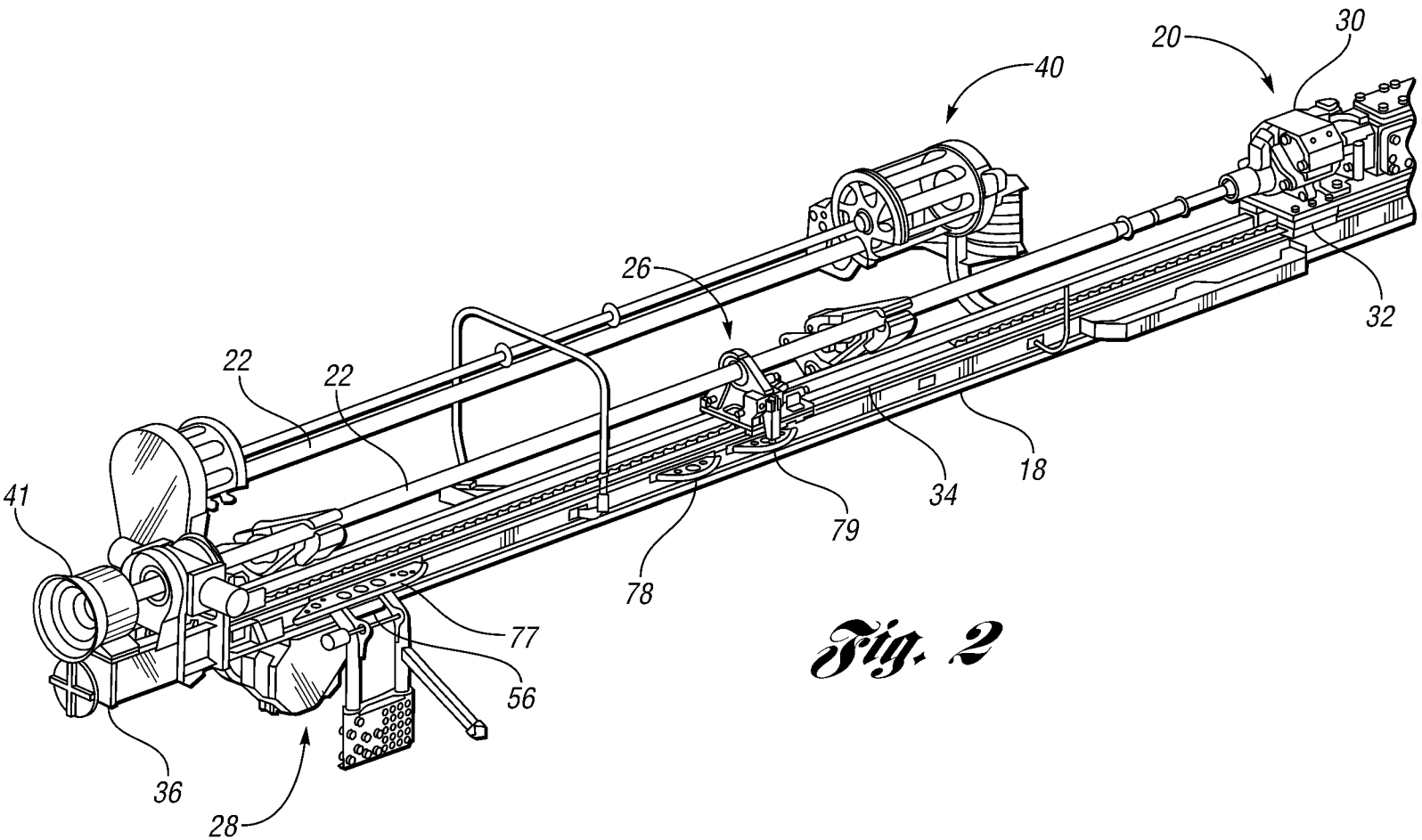
FIG. 2 is a perspective view of the drill system showing a drill assembly and a centralizing device mounted on a elongated support member.

Referring to FIGS. 1 and 2, the drill system 10 includes an elongated support member 18, such as a feed guide or drill guide, and a drill assembly 20, such as a rock drill assembly, movably associated with the support member 18. One or more drill rods 22 may be removably coupled to the drill assembly 20, along with an associated drill bit 24 coupled to an end of one of the drill rods 22, for drilling one or more holes, as explained below in detail. The drill system 10 further includes a centralizing device or centralizer 26 movably associated with the support member 18, and configured to assist in aligning the one or more drill rods 22 during a drilling operation. In addition, the drill system 10 includes a drive system 28 for moving the drill assembly 20 and the centralizer 26 along the support member 18.

While the drill assembly 20 may have any suitable configuration, in the embodiment show in FIG. 2, the drill assembly 20 includes a rock drill 30 mounted on a drill slide bracket 32, which may be slidably mounted on one or more guide rails 34 of the support member 18. The rock drill 30 is configured to be removably connected to the one or more drill rods 22, and is further configured to sufficiently move the drill rods 22 and drill bit 24 so that the drill bit 24 can fracture or otherwise break up rock or other material to form a hole. The rock drill 30 may also slide along the support member 18 to move the drill bit 24 downward, for example, so that the drill bit 24 can make the hole deeper. When the rock drill 30 is moved proximate a first end, such as a lower end 36, of the support member 18, the rock drill 30 may be disconnected from the one or more drill rods 22 and moved toward an opposite second end, such as an upper end 38, of the support member 18. Another drill rod 22 may then be connected between the rock drill 30 and the existing drill rods 22, and drilling may resume. In that regard, the drill system 10 may include a rotatable rod carousel arrangement 40 that holds one or more drill rods 22 and that may be rotated to position an additional rod 22 between the rock drill 30 and the existing drill rods 22.

The centralizer 26 is movably associated with the support member 18 such that, during use, the centralizer 26 may remain positioned between the drill assembly 20 and a drill guide member 41 positioned at the lower end 36 of the support member 18. Furthermore, the centralizer 26 is configured to receive an intermediate section of one of the drill rods 22 to guide the drill rod 22 during a drilling operation.

Figure 3:
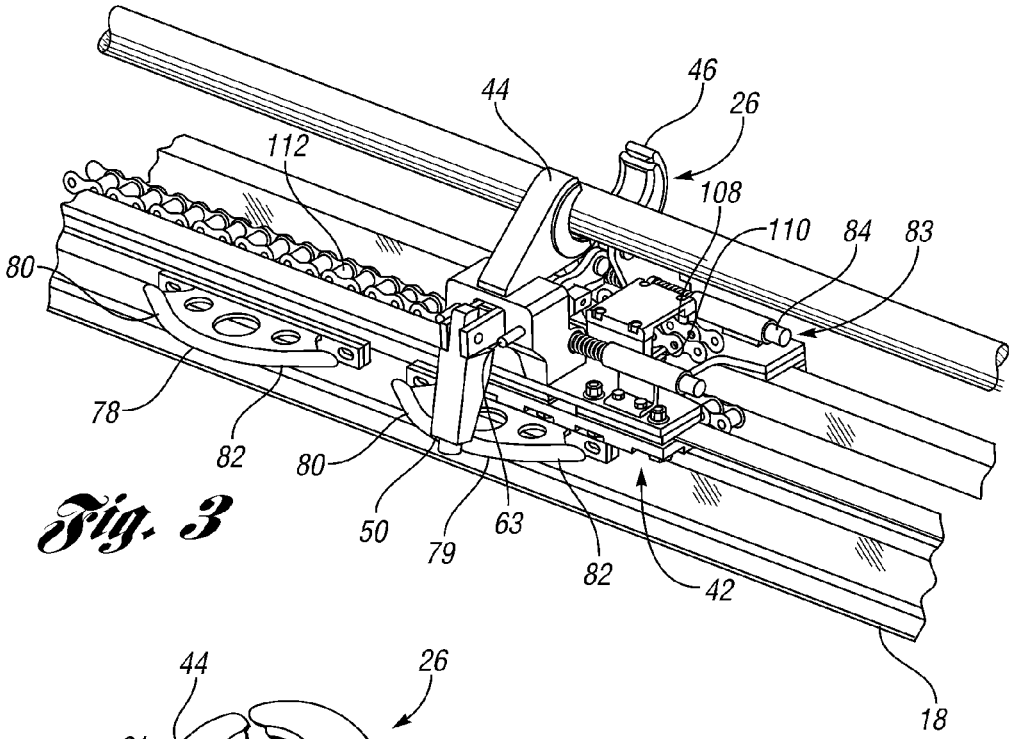
FIG. 3 is an enlarged view of the centralizing device, which includes a movable jaw and a latch arm for moving the movable jaw.
Figure 4:
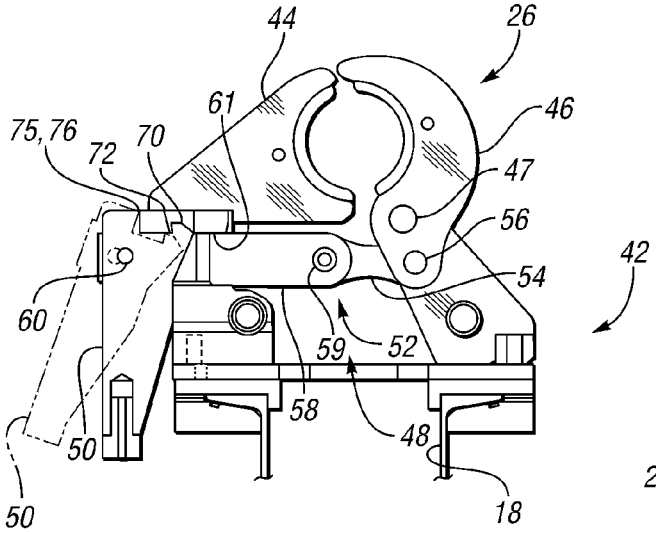
FIG. 4 is a cross sectional view of the centralizing device, taken through the movable jaw and latch arm, showing the movable jaw in a closed position and the latch arm in a locked position.
Figure 5:
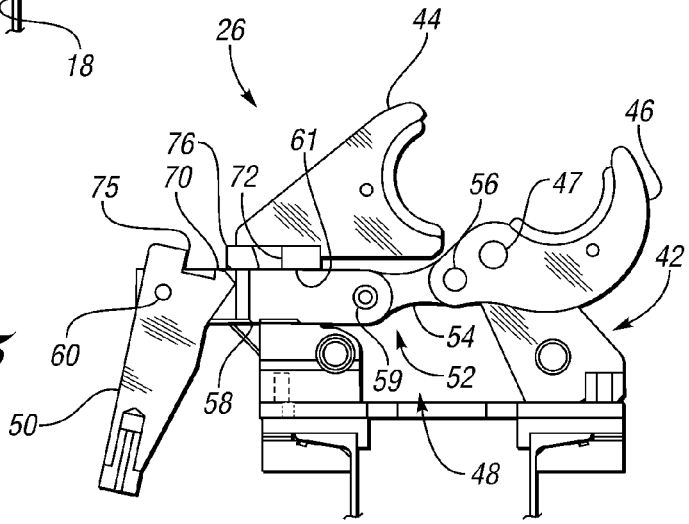
FIG. 5 is a cross sectional view similar to FIG. 4 showing the movable jaw in an opened position and the latch arm in an unlocked position.

In the embodiment illustrated in FIGS. 3-5, the centralizer 26 includes a device body 42 slidably mounted on the support member 18, a fixed jaw 44 that is fixed with respect to the device body 42, and a movable jaw 46 that is pivotally attached to the device body 42, such as with a pivot pin 47, such that the movable jaw 46 is movable with respect to the device body 42 between an open position, shown in FIGS. 3 and 5, and a closed position, shown in FIG. 4, for retaining a drill rod 22. The centralizer 26 further includes a linkage arrangement 48 having one or more link members connected to the movable jaw 46, and a latch arm 50 pivotally attached to the linkage arrangement 48 and configured to move the movable jaw 46 between the open and closed positions, as explained below in detail.

Figure 6:
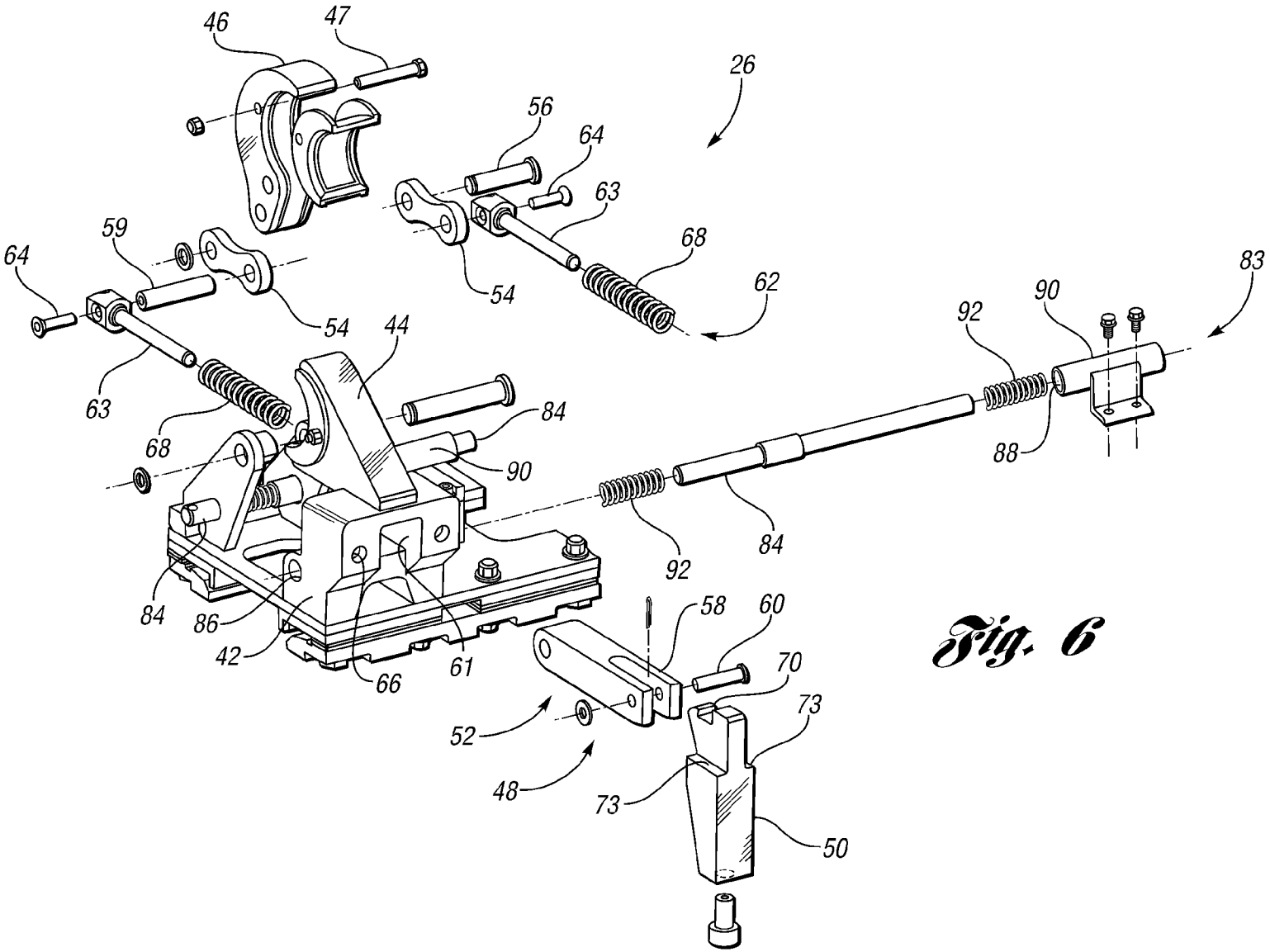
FIG. 6 is a partially exploded view of the centralizing device.

In the embodiment shown in FIGS. 4-6, the linkage arrangement 48 includes a linkage 52 having two first link members 54 attached to the movable jaw 46 with a fastener member, such as a pin 56. The linkage 52 also includes a second link member 58, such as a rod or plunger, attached to the first link members 54 and the latch arm 50 with suitable fastener members, such as pins 59 and 60. The second link member 58 is received in a laterally extending guide slot 61 of the device body 42, and the guide slot 61 is configured to guide lateral movement of the second link member 58.

Figure 7:
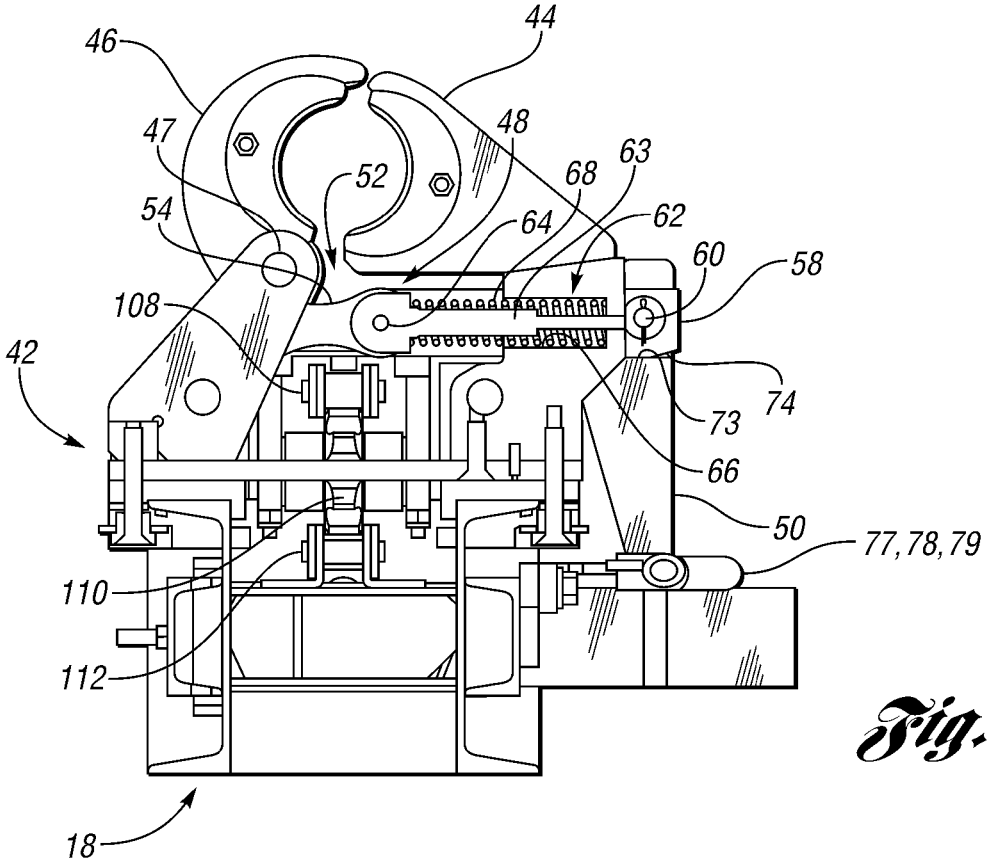
FIG. 7 is a cross sectional view of the centralizing device showing a biasing device for urging the movable jaw toward the closed position.
Figure 8:
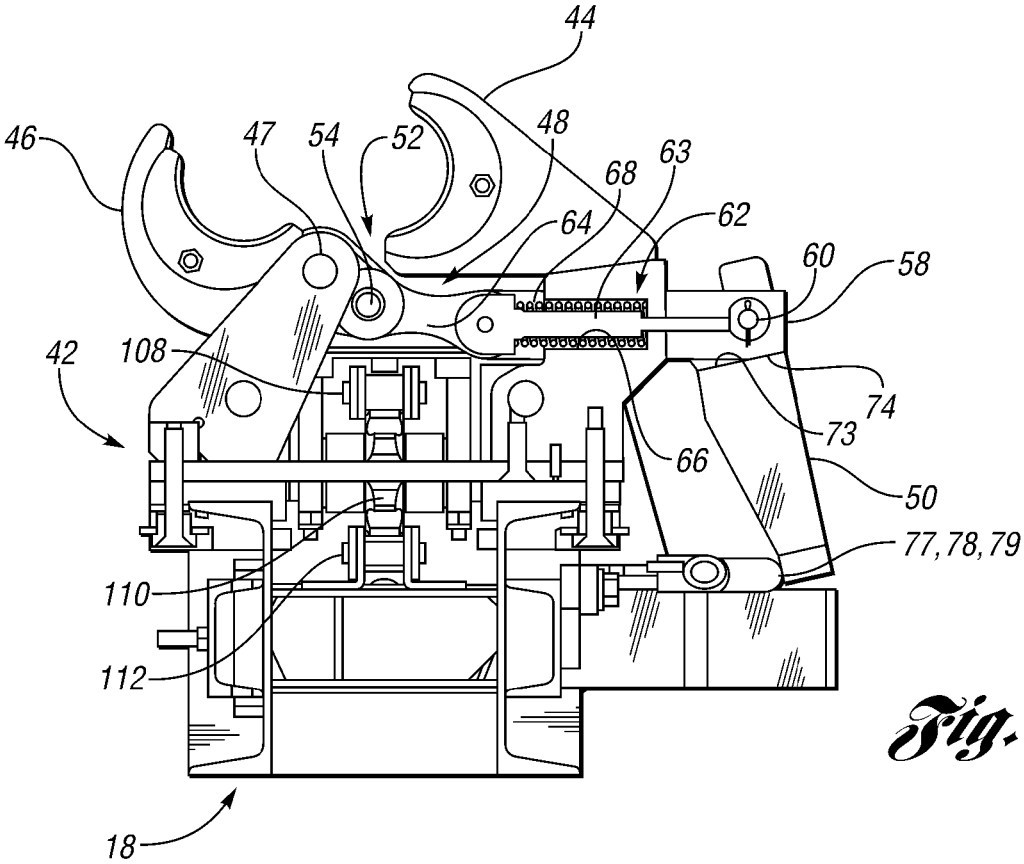
FIG. 8 is a cross sectional view similar to FIG. 7 showing the biasing device in a compressed state and the movable jaw in the opened position.

In addition, referring to FIGS. 6-8, the linkage arrangement 48 includes a biasing member or device 62 for urging the linkage 52 toward an extended position to thereby urge the movable jaw 46 toward the closed position. While the biasing device 62 may have any suitable configuration, in the illustrated embodiment, the biasing device includes two push rods 63 attached to the linkage 52 with fasteners, such as screws 64, that are also connected to the pin 59. The rods 63 extend into bores 66 formed in the device body 42, and are urged away from the latch arm 50 by springs 68 that are also received in the bores 66.

As another example, the latch arm 50 may be connected to the movable jaw 46 in any suitable manner, such as with any suitable connection arrangement.

Returning to FIGS. 4 and 5, the latch arm 50 has a locking feature 70 that is engageable with the device body 42 for holding the latch arm 50 in a locked position to thereby hold the movable jaw 46 in the closed position during a drilling operation. While the locking feature 70 may have any suitable configuration, in the illustrated embodiment, the locking feature 70 is formed as a projection that is insertable into an opening, such as a notch 72, formed in the device body 42. As another example, the locking feature 70 may be configured as a notch, recess or other opening that receives a projection formed on the device body 42.

The latch arm 50 may be manually moved from the locked position, shown in FIG. 4, to an unlocked position shown in FIG. 5, to thereby move the movable jaw 46 from the closed position to the open position. In that regard, the latch arm 50 may first be pivoted about the pin 60 and with respect to the second link member 58 to an initial or preliminary unlocked position, shown in phantom lines in FIG. 4, to disengage the locking feature 70 from the notch 72. In the preliminary unlocked position, one or more portions of the latch arm 50, such as side portions 73 shown in FIGS. 6 and 7, may engage a surface 74 of the second link member 58 to inhibit or prevent further pivoting motion of the latch arm 50. After the latch arm 50 reaches the preliminary unlocked position, additional outward urging of the latch arm 50 will cause the latch arm 50 to move outwardly, such as laterally, without pivoting until the latch arm 50 reaches the unlocked position shown in FIG. 5, which position may also be referred to as an unlocked and extended position. As the latch arm 50 moves outwardly, the latch arm 50 will pull on the linkage 52 to thereby move the movable jaw 46 to the open position shown in FIGS. 5 and 8.

Upon release of the latch arm 50, the latch arm 50 may be moved back to the locked position by the above described biasing device 62. In that regard, referring to FIGS. 5 and 8, the biasing device 62 is configured to bias or push the second link member 58 toward the movable jaw 46, such that the second link member 58 pulls the latch arm 50 toward the device body 42. Upon engagement of a projecting portion 75 of the latch arm 50 against a surface 76 of the device body 42, further pulling of the latch arm 50 by the biasing device 62 causes the latch arm 50 to pivot about the pin 60 toward the locked position so that the locking feature 70 engages the notch 72, as shown in FIG. 4.

As another example, the support member 18 may be provided with one or more cam members, such as ramps, that are configured to automatically move the latch arm 50 from the locked position to the unlocked position. In the embodiment shown in FIG. 2, for example, the support member 18 includes a first ramp 77 attached to a body of the support member 18 proximate the lower end 36 of the support member 18, a second ramp 78 attached to the support member body between the first ramp 77 and the second end 38 of the support member 18, and a third ramp 79 disposed proximate the second ramp 78 and between the second ramp 78 and the second end 38. The first ramp 77 is engageable with a follower portion of the latch arm 50 when the centralizer 26 is moved toward the first end 36 of the support member 18, and the second and third ramps 78 and 79, respectively, are engageable with the follower portion of the latch arm 50 when the centralizer 26 is moved toward the second end 38 of the support member 18. Upon engagement with the latch arm 50, each ramp 77, 78 and 79 is configured to move the latch arm 50 away from the locked position to thereby move the movable jaw 46 to the open position, in a similar manner as described above with respect to the manual method for moving the latch arm 50. In that regard, referring to FIGS. 3 and 7, each ramp 77, 78 and 79 has a cam surface, such as an angled ramp surface 80, that contacts the latch arm 50 and urges the latch arm 50 to first pivot about the pin 60, and then move outwardly, when the centralizer 26 is moved with respect to the particular ramp.

The second and third ramps 78 and 79 also each have an additional cam surface, such as an additional angled ramp surface 82, that extends back toward the support member body and that allows the latch arm 50 to return to the locked position when the centralizer 26 is moved further toward the upper end 38 of the support member 18. When the centralizer 26 is moved back toward the lower end 36 of the support member 18, the additional angled ramp surfaces 82 function to move the latch arm 50 toward the unlocked position, and the angled ramp surfaces 80 function to allow the latch arm 50 to return to the locked position.

Figure 9:
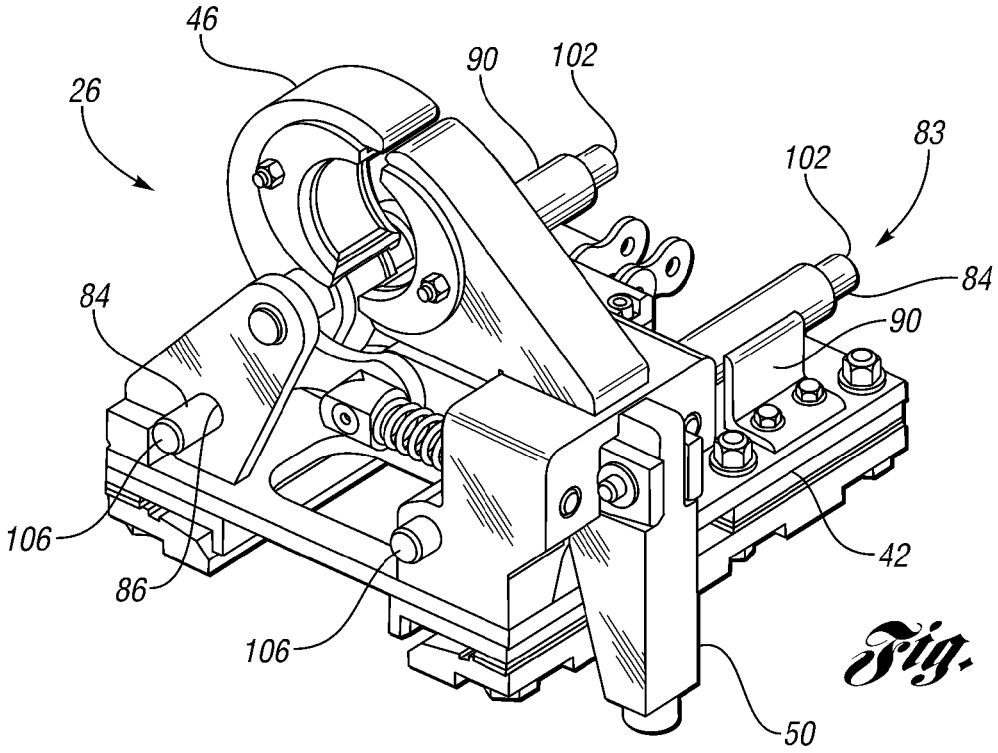
FIG. 9 is a perspective view of the centralizing device showing portions of a bumper arrangement.

Referring to FIGS. 3, 6 and 9, the centralizer 26 may also include a bumper arrangement 83 having one or more contact members 84, such as rods or bumpers, that are movably mounted on the device body 42, and that are engageable with the support member 18 and drill assembly 20, as explained below in detail. In the illustrated embodiment, the bumper arrangement 83 includes two contact members 84 slidably mounted in bores 86 formed in the device body 42, as well as in bores 88 formed in support brackets 90 attached to the device body 42. The bumper arrangement 83 further includes two spring members 92 for each contact member 84, and the spring members 92 are configured to allow movement of the device body 42 with respect to the contact members 84. In the illustrated embodiment, each spring member 92 is disposed between an engaging portion, such as a shoulder 94, on a contact member 84 and an engaging portion, such as a shoulder 96, formed on the device body 42 or an engaging portion, such as a shoulder 98, formed on the support bracket 90.

Figure 10:
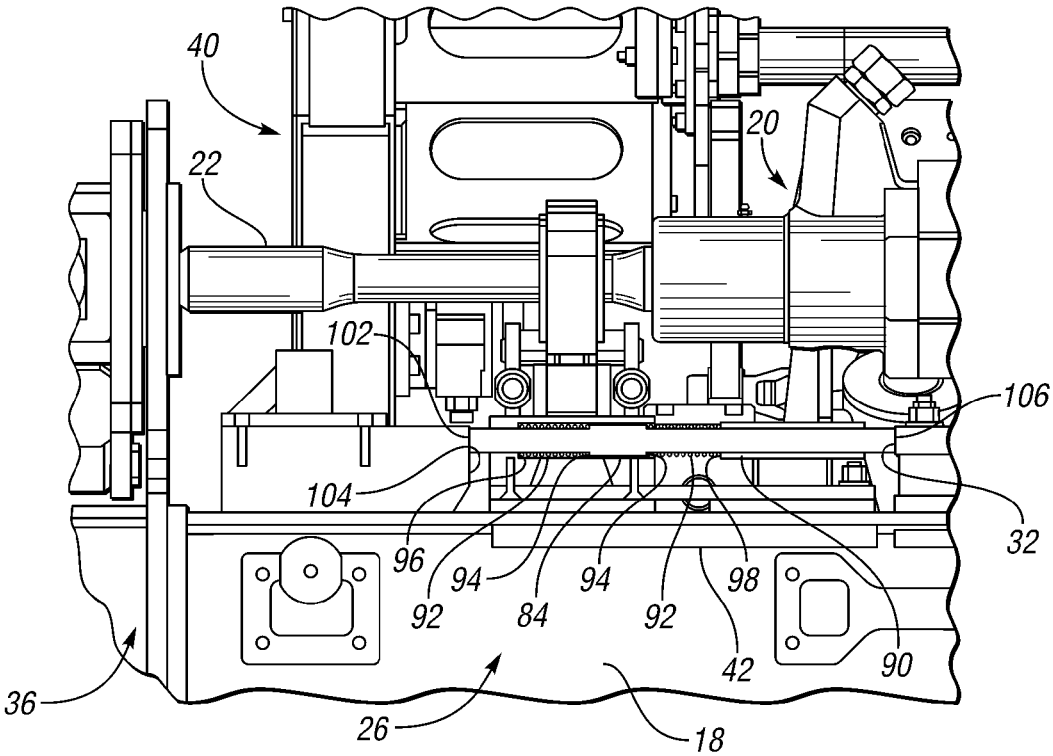
FIG. 10 is a cross sectional view of the centralizing device showing further details of the bumper arrangement.

Referring to FIGS. 9 and 10, when the centralizer 26 is moved sufficiently toward the lower end 36 of the support member 18 by the drive system 28, one end 102 of each contact member 84 is configured to engage a corresponding contact member or portion of the support member 18, such as a travel stop or contact plate 104 attached to the support member body. After engagement of the contact members 84 with the support member 18, the device body 42 of the centralizer 26 is able to move with respect to the contact members 84 through action of the drive system 28, if such movement is needed, until the drill assembly 20 contacts opposite ends 106 of the contact members 66. With such a configuration, the centralizer 26 is able to account for tolerance variations and/or changes in characteristics of the drive system 28, to thereby help prevent component damage.

Referring to FIGS. 1 and 3, the drive system 28 may be any suitable system for moving the drill assembly 20 and the centralizer 26 along a longitudinal axis of the support member 18. For example, the drive system 28 may be a chain drive system including a drive chain 108 (shown in a partial segment for clarity) having first and second ends connected to opposite ends of the rock drill assembly 20. The drive chain 108 and drill assembly 20 may form a loop with the drive chain 108 wrapping around a drive sprocket and one or more additional sprockets, such as an idler sprocket and a drive idler sprocket. The drive sprocket may be driven by a motor, such as an electric motor or hydraulic motor, that causes the chain 108 to move, which thereby causes the drill assembly 20 to move.

Movement of the drive chain 108 may also cause the centralizer 26 to move. For example, referring FIGS. 3-5, the centralizer 26 may include a rotatable member, such as a sprocket 110, that is rotatably mounted on the device body 42 and that extends between the drive chain 108 and a fixed section of chain 112 mounted on the support member 18. The sprocket 110 rotatably engages the chains 108 and 112 and is driven by the drive chain 108 such that when the drive chain 108 is moved in order to move the drill assembly 20, the sprocket 110 moves along the fixed chain section 112 and slides the device body 42 along the support member 18.

Furthermore, the sprocket 110 and fixed chain section 112 may be configured as a reduction mechanism that enables the centralizer 26 to move a portion of the distance that the drill assembly 20 moves. For example, as the drill assembly 20 translates a particular distance with respect to the support member 18, the sprocket 110 and fixed chain section 112 may be configured to move the centralizer 26 a portion, such as half, of that distance so that the centralizer 26 may remain equally spaced between the drill slide bracket 32 of the drill assembly 20 and the contact plate 104 at the lower end 36 of the support member 18.

As another example, the drive system 28 may be configured as a cable drive system. As yet another example, the drill system 10 may be provided with two separate drive systems. With such an arrangement, the drill assembly 20 and centralizer 26 may each be moved by a different drive system.

With reference to FIGS. 1-10, operation of the drill system 10 will now be described in more detail. When it is desired to commence a drilling operation, the drive system 28 may be activated to move the drill assembly 20 and centralizer 26 toward the second end 38 of the support member 18 in order to mount a drill rod 22 on the drill assembly 20. Depending on the length of the initial drill rod 22, the centralizer 26 may be moved to the second ramp 78 or the third ramp 79. Upon engagement with either ramp 78 or 79, the latch handle 50 is urged against the bias of the biasing device 62 toward the unlocked position such that the movable jaw 46 is moved to the open position. A drill rod 22 is then mounted on the drill assembly 20 via the rod carousel arrangement 40, such that an intermediate portion of the drill rod 22 is received by the centralizer 26.

The drive system 28 may then be operated to move the drill assembly 20 and centralizer 26 toward the lower end 36 of the support member 18. As the centralizer 26 moves away from the ramp 78 or 79, the latch arm 50 will move along the angled surface 80 and return to the locked position, thereby moving the movable jaw 46 back to the closed position. If the centralizer 26 was initially moved to the third ramp 79, then the centralizer 26 will also pass along the second ramp 78 as the centralizer 26 is moved toward the lower end 36 of the support member 18. As a result, the latch arm 50 will move from the closed position to the open position, and then back to the closed position as the centralizer 26 is moved along the second ramp 78.

In the closed position, the movable jaw 46 functions to retain the intermediate portion of the drill rod 22 in the centralizer 26 such that the centralizer 26 may guide the drill rod 22 during the drilling operation. As mentioned above, the biasing device 62 urges the movable jaw 46 toward the closed position by urging the linkage 52 toward the extended position. The biasing device 62 also urges the latch arm 50 toward the locked position. Furthermore, the locking feature 70 of the latch arm 50 holds the latch arm 50 in the locked position, thereby inhibiting or preventing the movable jaw 46 from moving to the open position even if the drill rod 22 exerts lateral forces on the movable jaw 46 during the drilling operation. For example, lateral forces exerted on the movable jaw 46 may cause the locking feature 70 of the latch arm 50 to be urged into engagement with sidewalls of the device body 42 that define the notch 72, such that further movement of the latch arm 50 and movable jaw 46 is inhibited or prevented. With the above configuration, pivoting motion of the latch arm 50 is required in order to unlock the locking feature 70 from the device body 42, so that the movable jaw 46 may be moved to the open position.

During the drilling operation, the drill assembly 20 sufficiently moves the drill rod 22 and associated drill bit 24 to cause the drill bit 24 to fracture or otherwise break up rock or other material to form a hole. The drive system 28 may also be activated to move the drill assembly 20 and centralizer 26 along the support member 18 to move the drill bit 24 downward, for example, so that the drill bit 24 can make the hole deeper. Furthermore, the centralizer 26 cooperates with the drill assembly 20 and the drill guide member 41 to align the drill rod 22 during the drilling operation.

When the centralizer 26 is moved sufficiently toward the lower end 36 of the support member 18, the ends 102 of the contact members 84 of the bumper arrangement 83 engage the contact plate 104. At the same time, the drill assembly 20 may also contact the opposite ends 106 of the contact members 84, thereby preventing further movement of the drill assembly 20 and drive system 28. However, in the event of tolerance variations and/or changes in characteristics of the drive system 28, such as stretch in the drive chain 108, which may cause the drill assembly 20 to be spaced slightly away from the ends 106 of the contact members 84 when the contact members 84 engage the contact plate 104, the bumper arrangement 83 is configured to allow the device body 42 to move with respect to the contact members 84 until the drill assembly 20 contacts the ends 106 of the contact members 84. With such a configuration, damage to components of the drill system 10 may be minimized.

The drill assembly 20 may then be disconnected from the drill rod 22, and the drive system 28 may be operated to move the drill assembly 20 and centralizer 26 back toward the upper end 38 of the support member 18. An additional drill rod 22 may then be attached to the drill assembly 20 and coupled to the initial drill rod 22 at a coupling joint, so that the drilling operation may be continued. When the drill assembly 20 and centralizer 26 are then moved back toward the lower end 36 of the support member 18 such that the centralizer 26 engages the first ramp 77, the first ramp 77 will cause the movable jaw 46 to move to the open position, thereby allowing the coupling joint to pass through the centralizer 26.

The above process may be repeated until the drill system 10 has drilled the hole to the desired depth. With the centralizer 26 described above, the drill rods 22 may be effectively retained and aligned so that the hole may be drilled accurately and efficiently.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A drill system for use with a drill rod, the system comprising:

a support member;

a drill assembly movably associated with the support member and configured to be connected to the drill rod; and a centralizing device movably associated with the support member and configured to receive the drill rod, the centralizing device including a movable jaw and a latch arm connected to the jaw and configured to move the jaw between an open position and a closed position for retaining the drill rod, the latch arm being pivotable toward an unlocked position in order to move the jaw toward the open position and having a locking feature configured to hold the latch arm in a locked position to thereby hold the jaw in the closed position;

wherein the support member includes a cam member disposed proximate an end of the support member, the cam member being engageable with the latch arm when the centralizing device is moved toward the end of the support member, and wherein upon engagement with the latch arm, the cam member is configured to move the latch arm away from the locked position to thereby move the jaw to the open position.

2. The drill system of claim 1 wherein the centralizing device includes a device body slidably mounted on the support member, and the locking feature is engageable with the device body for holding the latch arm in the locked position.

3. The drill system of claim 2 wherein the device body includes a notch and the locking feature is configured as a projection that is insertable into the notch.

4. The drill system of claim 1 wherein the cam member is configured to pivot the latch arm away from the locked position and then move the latch arm laterally to thereby move the jaw to the open position.

5. The drill system of claim 1 further comprising a drive system associated with the drill assembly and the centralizing device for moving the drill assembly and the centralizing device with respect to the support member.

6. The drill system of claim 1 further comprising a fixed chain attached to the support member and a movable drive chain that is movable with respect to the support member, and wherein the centralizing device includes a sprocket that is engageable with the fixed chain and the drive chain such that movement of the drive chain causes the centralizing device to move with respect to the fixed chain.

7. A drill system for use with a drill rod, the system comprising:

a support member;

a drill assembly movably associated with the support member and configured to be connected to the drill rod; and a centralizing device movably associated with the support member and configured to receive the drill rod, the centralizing device including a movable jaw and a latch arm connected to the jaw and configured to move the jaw between an open position and a closed position for retaining the drill rod, the latch arm having a locking feature configured to hold the latch arm in a locked position to thereby hold the jaw in the closed position, wherein the support member includes a contact portion, and the centralizing device includes a contact member and a device body movable with respect to the contact member and slidably mounted on the support member, the contact member having a first end that is engageable with the contact portion of the support member, and wherein the centralizing device is configured to allow movement of the device body with respect to the contact member after the first end of the contact member has engaged the contact portion of the support member.

8. The drill assembly of claim 7 wherein the centralizing device includes a spring member associated with the contact member for allowing movement of the device body with respect to the contact member.

9. The drill system of claim 7 wherein the contact member has a second end that is engageable with the drill assembly.

10. The drill system of claim 9 further comprising a drive system associated with the drill assembly and the centralizing device for moving the drill assembly and the centralizing device with respect to the support member, wherein movement of the drill assembly toward the end of the support member is inhibited when the first end of the contact member is engaged with the contact portion of the support member and the second end of the contact member is engaged with the drill assembly.

11. A drill system for use with a drill rod, the system comprising:

a drill guide having first and second ends, a first ramp disposed proximate the first end, and a second ramp disposed between the first ramp and the second end;

a drill assembly movably associated with the drill guide and configured to be connected to the drill rod; and a centralizing device movably associated with the drill guide such that the centralizing device remains positioned between the drill assembly and the first end of the drill guide during use, the centralizing device being configured to receive an intermediate section of the drill rod to guide the drill rod, the centralizing device including a device body having a notch and slidably mounted on the drill guide, a movable jaw that is movable with respect to the device body between an open position and a closed position for retaining the drill rod, a link member connected to the jaw, and a latch arm pivotally attached to the link member and configured to move the jaw between the open and closed positions, the latch arm having a locking feature comprising a projection that is engageable with the notch in the device body for holding the latch arm in a locked position to thereby hold the jaw in the closed position;

wherein the first ramp is engageable with the latch arm when the centralizing device is moved toward the first end of the drill guide, and the second ramp is engageable with the latch arm when the centralizing device is moved toward the second end of the drill guide, and wherein upon engagement with the latch arm, each ramp is configured to move the latch arm away from the locked position to thereby move the jaw to the open position.

12. The system of claim 11 wherein the drill guide further includes a third ramp disposed between the second ramp and the second end of the drill guide, the third ramp being engageable with the latch arm when the centralizing device is moved beyond the second ramp toward the second end, and wherein upon engagement with the latch arm, the third ramp is configured to move the latch arm away from the locked position to thereby move the jaw to the open position.

13. The drill system of claim 11 further comprising a drive system associated with the drill assembly and the centralizing device for moving the drill assembly and the centralizing device with respect to the drill guide.

14. The drill system of claim 11 wherein upon engagement with the latch arm, each ramp is configured to pivot the latch arm away from the locked position and then move the latch arm laterally toward an unlocked position to thereby move the jaw to the open position.

15. A drill system for use with a drill rod, the system comprising:

a drill guide having first and second ends, a first ramp disposed proximate the first end, and a second ramp disposed between the first ramp and the second end;

a drill assembly movably associated with the drill guide and configured to be connected to the drill rod; and a centralizing device movably associated with the drill guide such that the centralizing device remains positioned between the drill assembly and the first end of the drill guide during use, the centralizing device being configured to receive an intermediate section of the drill rod to guide the drill rod, the centralizing device including a device body slidably mounted on the drill guide, a movable jaw that is movable with respect to the device body between an open position and a closed position for retaining the drill rod, a link member connected to the jaw, and a latch arm pivotally attached to the link member and configured to move the jaw between the open and closed positions, the latch arm having a locking feature that is engageable with the device body for holding the latch arm in a locked position to thereby hold the jaw in the closed position;

wherein the first ramp is engageable with the latch arm when the centralizing device is moved toward the first end of the drill guide, and the second ramp is engageable with the latch arm when the centralizing device is moved toward the second end of the drill guide, and wherein upon engagement with the latch arm, each ramp is configured to move the latch arm away from the locked position to thereby move the jaw to the open position and wherein the drill guide includes a contact portion disposed proximate the first end, and the centralizing device includes a contact member having a first member end that is engageable with the contact portion of the drill guide, and wherein the device body is movable with respect to the contact member such that movement of the device body is permitted after the first member end of the contact member has engaged the contact portion of the drill guide.

16. The drill system of claim 15 wherein the contact member has a second member end that is engageable with the drill assembly.

17. The drill system of claim 16 further comprising a drive system associated with the drill assembly and the centralizing device for moving the drill assembly and the centralizing device with respect to the drill guide, wherein movement of the drill assembly toward the first end of the drill guide is inhibited when the first member end of the contact member is engaged with the contact portion of the drill guide and the second member end of the contact member is engaged with the drill assembly.

18. A drill system for use with a drill rod, the system comprising:

a support member;

a drill assembly movably associated with the support member and configured to be connected to the drill rod; and a centralizing device including a device body having a notch, the device body movably associated with the support member and configured to receive the drill rod, the centralizing device including a movable jaw and a latch arm connected to the jaw and configured to move the jaw between an open position and a closed position for retaining the drill rod, the latch arm having a locking feature comprising a projection engagable with the notch to hold the latch arm in a locked position to thereby hold the jaw in the closed position;

wherein the support member includes a cam member disposed proximate an end of the support member, the cam member being engageable with the latch arm when the centralizing device is moved toward the end of the support member, and wherein upon engagement with the latch arm, the cam member is configured to move the latch arm away from the locked position to thereby move the jaw to the open position.

19. The drill system of claim 18 wherein the latch arm is pivotable toward an unlocked position in order to move the jaw toward the open position.

20. The drill system of claim 18 wherein the cam member is configured to pivot the latch arm away from the locked position and then move the latch arm laterally to thereby move the jaw to the open position.

21. The drill system of claim 18 further comprising a drive system associated with the drill assembly and the centralizing device for moving the drill assembly and the centralizing device with respect to the support member.

* * * * *